United States Patent [19]

Fukae

[11] Patent Number: 4,780,740

[45] Date of Patent: Oct. 25, 1988

[54] PAPER FEEDING CASSETTE FOR A PRINTING APPARATUS

[75] Inventor: Kensuke Fukae, Allendale, N.J.

[73] Assignee: Kentek Information Systems, Inc., Allendale, N.J.

[21] Appl. No.: 65,102

[22] Filed: Jun. 26, 1987

Related U.S. Application Data

[63] Continuation of Ser. No. 718,945, Apr. 2, 1985, abandoned.

[51] Int. Cl.[4] ..... G03G 21/00

[52] U.S. Cl. ..... 355/3 SH; 271/171; 271/255

[58] Field of Search ..... 355/3 R, 3 SH, 14 SH; 271/164, 170, 171, 255

[56] References Cited

U.S. PATENT DOCUMENTS

| | | | |
|---|---|---|---|
| 3,977,666 | 8/1976 | Suzuki et al. | 271/170 X |
| 4,032,136 | 6/1977 | Komaba et al. | 271/171 X |
| 4,231,566 | 11/1980 | Suzuki | 271/171 X |
| 4,294,535 | 10/1981 | Ariyama et al. | 355/3 SH X |
| 4,302,098 | 11/1981 | Kan et al. | 355/3 SH X |
| 4,444,386 | 4/1984 | Murata et al. | 271/171 X |
| 4,511,904 | 4/1985 | Takahashi | 271/171 X |

FOREIGN PATENT DOCUMENTS

| | | | |
|---|---|---|---|
| 57-4835 | 1/1982 | Japan | 271/171 |
| 57-131642 | 8/1982 | Japan | 271/171 |
| 59-36037 | 2/1984 | Japan | 271/171 |
| 59-48403 | 3/1984 | Japan | 271/171 |
| 59-48406 | 6/1984 | Japan | 271/171 |
| 59-207335 | 11/1984 | Japan | 271/171 |
| 59-212332 | 12/1984 | Japan | 271/171 |
| 2130182 | 5/1984 | United Kingdom | 271/171 |

OTHER PUBLICATIONS

Colglazier et al.; "Paper Size Indication", IBM Technical Disclosure Bulletin; vol. 18, No. 7, Dec. 1975, pp. 2057–2058.

*Primary Examiner*—Fred L. Braun

*Attorney, Agent, or Firm*—Marmorek, Guttman & Rubenstein

[57] ABSTRACT

A paper cassette for storing and supplying paper to a smart printer or copier includes a frame for holding the paper, a movable longitudinal paper guide within the frame adjustable to the length of the paper, and a pair of movable horizontal paper guides within the frame adjustable to the width of the paper. The two movable horizontal guides are linked together so that they move symmetrically with respect to a longitudinal central axis of the frame. The longitudinal paper guide is adjustable independently of the adjustment of the pair of horizontal paper guides. The cassette further includes a first sensor connected to the longitudinal guide and a second sensor connected to one of the horizontal guides. These sensors travel along first and second predetermined paths in conjunction with movements of the longitudinal paper guide and the horizontal paper guides so that the positions of the paper guides are communicated to a controller which automatically formats the printing on the paper.

9 Claims, 5 Drawing Sheets

PAPER FEEDING CASSETTE FOR A PRINTING APPARATUS

This is a continuation of application Ser. No. 718,945, filed Apr. 2, 1985, now abandoned.

BACKGROUND OF THE INVENTION

This invention relates to a paper feeding cassette for a printing apparatus. More particularly, this invention relates to a cassette which stores and supplies paper to a printing appratus which may be either a printer connected to a computer or a copier. In the case of a printer connected to a computer, the printing apparatus produces originals on a sheet of paper. In the case of a copier, the printing apparatus reproduces an original on a sheet of paper.

With the recent surge in numbers and kinds of small computers that are available in the marketplace, there has come also a surge in the number and kinds of printers that can be connected to them. Today, among the different kinds of printers which can be interfaced to small computers are: dot matrix printers, daisy wheel printers, ink jet printers, electrographic printers, etc. Many advances have been made in the capabilities of these printers. The more advanced of these printers, contain their own internal computers or controllers which communicate information to the host computer and/or the user. For example, these printers are capable of diagnosing malfunctions and formatting the manner in which data is to be printed. Such printers, having their own internal computers, are often referred to as "smart" printers.

Similar advances have been made in copiers. Today, many of the copiers which are available on the market have their own internal computers. These internal computers are also able to diagnose and inform the user of any malfunction. In some instances, the copier is provided with detection means for detecting the size of the original. The internal computer can then make the appropriate adjustments so that the original is copied on the right size paper, for example, by selecting the cassette from which the paper will be taken. Such copiers may be referred to as "smart" copiers.

The present invention provides an improvement over prior art "smart" printers and copiers. Heretofore, in the case of prior art printers, it has been necessary for the user to input formatting information to the external computer. The external computer would then communicate this information to the smart printer's internal computer and the page would be printed with the proper format. For example, in order to achieve proper formatting, it was necessary for the user to specify the size of the paper in the paper cassette to the external computer. If this information were not communicated to the external computer, the printer would print on whatever size paper appeared in the paper cassette tray. This could lead to mistakes in formatting.

Similarly, problems could arise in the case of a smart copier. While it was not always necessary to input the paper size when one wanted the copy to be the same size as the original, the situation was otherwise when one wanted to make a copy of a different size. It was often necessary to "inform" the copier on which size paper to copy the original if one wanted to increase or decrease the size of the original. This was done by pressing the appropriate buttons on the console of the copier. In some cases, the copier or the printer was able to select paper of different sizes from different cassettes. However, no means were provided for the copier to adjust the size of the copy in response to the size of the paper in the paper input tray.

Thus, in prior art printers and copiers, including smart printers and copiers, it was necessary to conform the cassette or the paper in the cassette to the selected paper size. No means were available to automatically format the paper size without the intervention of the operator.

These problems are overcome by means of the present invention. In accordance with the present invention, it is no longer necessary for the user to manually input the paper size to the printer or the copier. The present invention provides means by which the smart printer or smart copier, as the case may be, senses the size of the paper which is loaded into the paper supply tray. This information is communicated to the internal computer in the smart printer or smart copier. Appropriate adjustments can then be made in the printer or copier so that the image formed on the paper is properly formatted without the need for the user to specify the paper size.

SUMMARY OF THE INVENTION

In one of its embodiments, the present invention comprises a paper cassette for storing and supplying paper to a printing apparatus. The printing apparatus may be either a printer connected to a computer or it may be a copier. The paper cassette comprises a frame which holds the paper, at least one movable paper guide for closely receiving the paper within the frame, and sensing means for sensing the position of the movable paper guide. The sensing means communicates the position of the paper guide to a controller, such as an internal computer, which controls the format of the paper size.

In another embodiment, the present invention comprises a printing apparatus, such as a printer or a copier. The printing apparatus comprises a housing, paper feeding means for supplying the paper to the housing, paper transport means for moving the paper through the various stations in the housing, and image forming means for forming an image on the paper. The printing apparatus is also provided with a controller for controlling the various functions of the printing apparatus, and paper ejection means for ejecting the paper from the housing. The paper feeding means includes a paper cassette comprising a frame, at least one movable paper guide for closely receiving the paper within the frame, and sensing means communicating the position of the paper guide to the controller, whereby formatting of the paper size is controlled by the position of the paper guide.

DETAILED DESCRIPTION OF THE INVENTION

Figure 1:
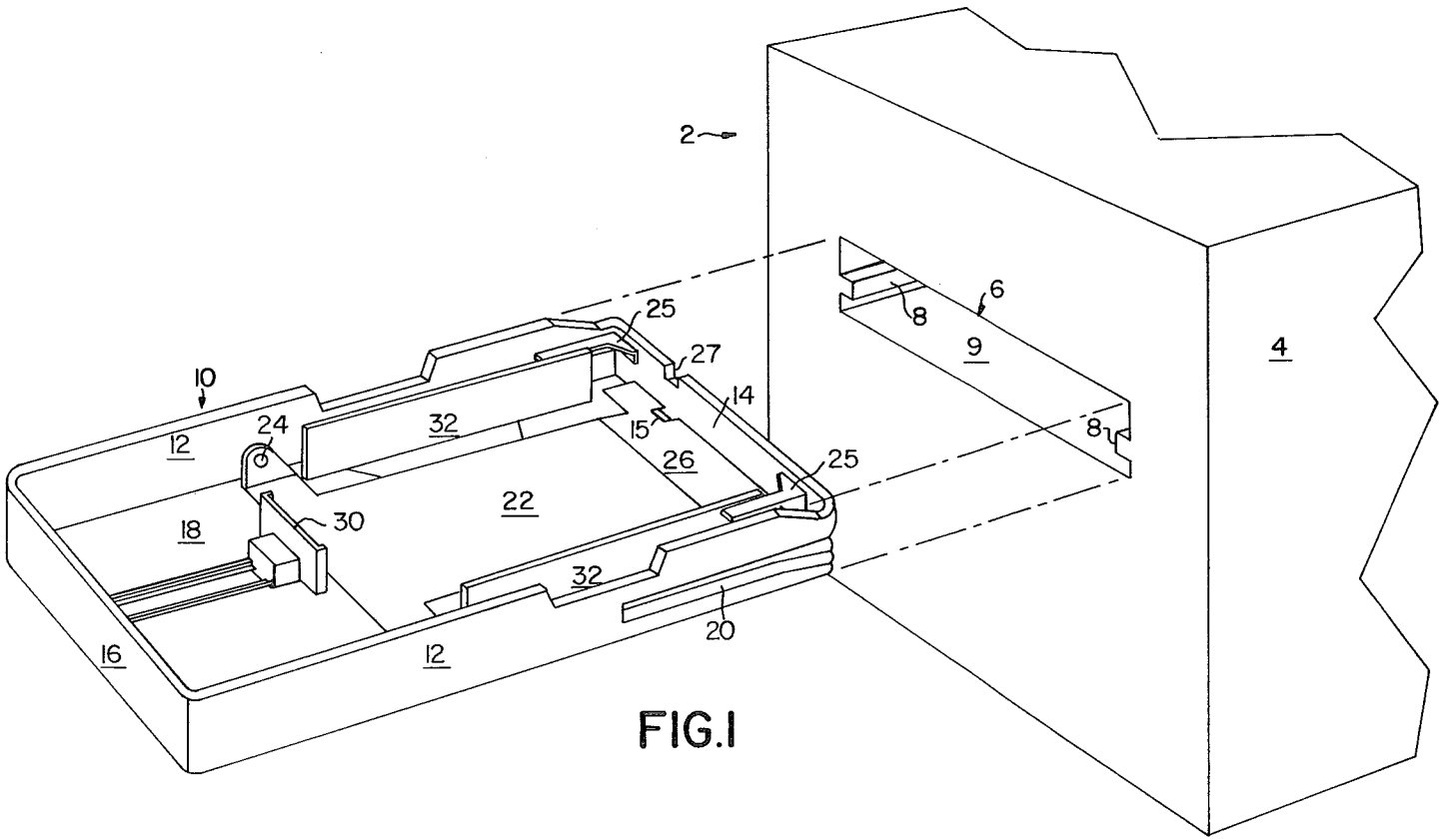
FIG. 1 is a perspective view of one embodiment of the paper feeding cassette of the present invention.
Figure 2:
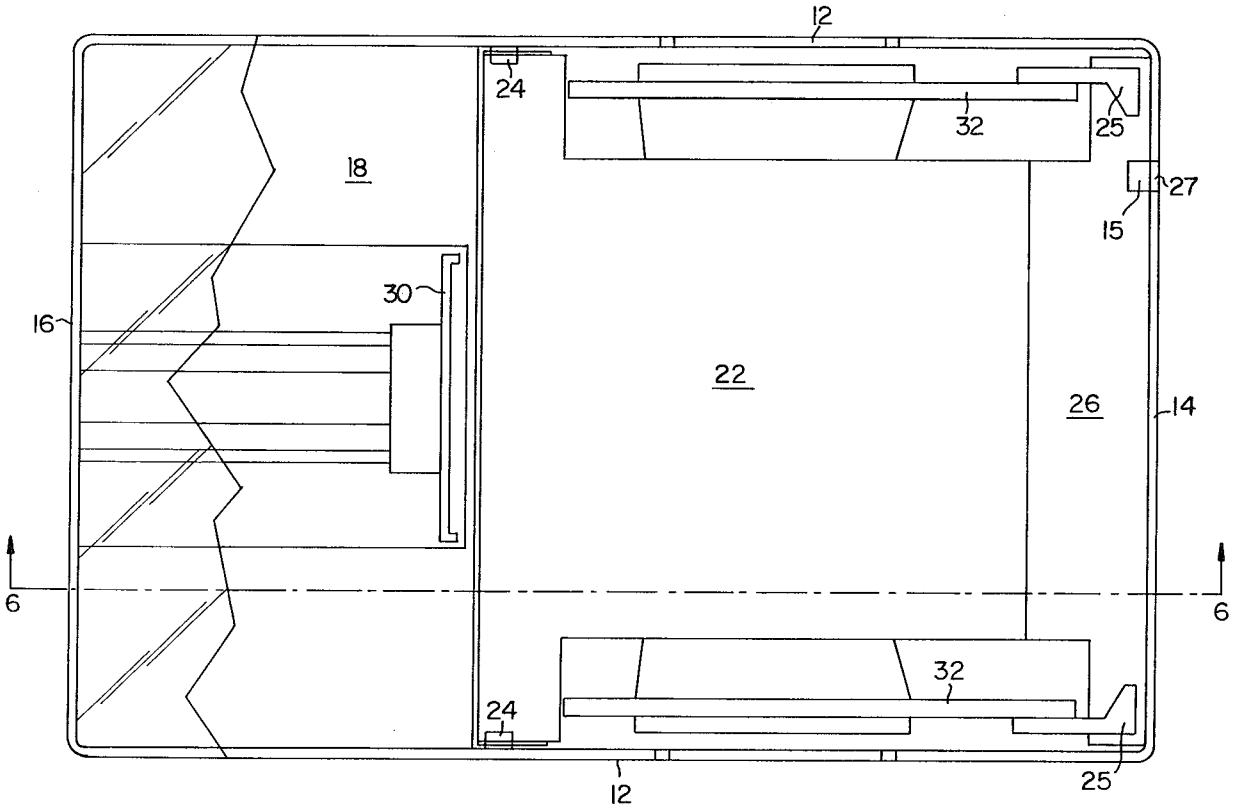
FIG. 2 is a top plan view of the paper feeding cassette.

Referring to the drawings, a printing apparatus, generally designated by the numeral 2 is illustrated. In this particular embodiment, printing apparatus 2 is an electrographic printer or copier. However, other forms of printers and copiers are contemplated by the present invention.

Printing apparatus 2 contains an internal computer (not shown) for controlling the various functions of the apparatus as well as for detecting the status of the various stations in the apparatus. As shown schematically in FIG. 1, printing apparatus 2 has a housing 4 which includes an insertion slot 6. Along the inner sidewalls of insertion slot 6 are tracks 8. A plate 9, the characteristics of which are discussed in further detail below, forms the bottom of insertion slot 6.

One particular embodiment of a paper feeding cassette of the present invention, generally designated by the numeral 10, is illustrated in the drawings. Paper feeding cassette 10 has sidewalls 12, a front wall 14, a back wall 16 and a bottom 18. A cover or lid (not shown) made of plastic or of any other suitable material, may be hinged to back wall 16. The purpose of the cover is to reduce the amount of dust which enters into paper cassette 10. On the outside of sidewalls 12, near the front portions thereof, are channels 20.

Figure 3:
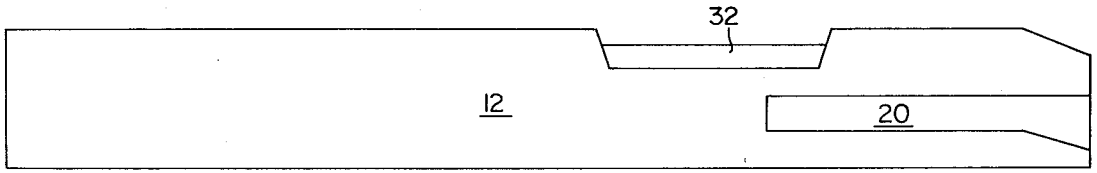
FIG. 3 is a side view of the paper feeding cassette.
Figure 6:
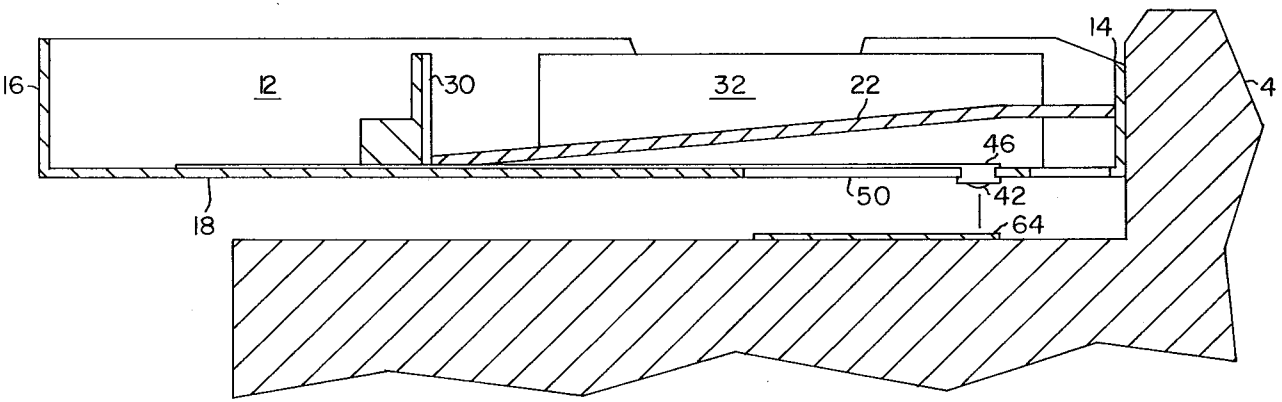
FIG. 6 is a cross-sectional view of the paper feeding cassette.

Cassette 10 is designed to be received within insertion slot 6 of printing apparatus 2. Tracks 8 are dimensioned to fit into channels 20 of the sidewall. Thus, cassette 10 may be slidably mounted within printing apparatus 2. When cassette 10 is fully inserted within insertion slot 6, a spring loaded lever arm (not shown) is activated. The purpose of this spring loaded lever arm will be discussed hereinbelow. As can best be seen in FIG. 3, the front portions of channel 20, i.e., those portions of channels 20 nearest front wall 14, are flared so as to ease mating of tracks 8 with channels 20.

Sidewalls 12, front wall 14, back wall 16 and bottom 18 of paper cassette 10 may be made from any suitable material, such as a plastic material. Sitting atop bottom 18 is a receiving plate 22 which, desirably, is made from a metal material. In normal usage, paper is stacked on receiving plate 22. The rear portion of receiving plate 22 is hinged to sidewalls 12 by means of pivots 24. The front portion of receiving plates 22 is free to rise as the size of the stack of paper on top of receiving plate 22 diminishes until plate 22 is stopped by corner breakers 25.

Desirably, the front portion 26 of receiving plate 22 is sloped downward slightly. This slight incline improves delivery of the paper when printing apparatus 2 is in use. Desirably also, a strip (not shown) of a material having a high coefficient of friction, such as a cork-like material, is placed width-wise across front portion 26 of receiving plate 22. This strip increases the surface friction between metal receiving plate 22 and the paper and improves the feeding operation.

The method by which single sheets of paper are fed into the housing for processing is well known to those skilled in the art. A spring loaded lever arm (not shown) urges receiving plate 22 with the stack of paper on it upward. The top sheet of the stack is engaged by feed rollers (not shown) above cassette 10. As the feed rollers rotate, the top sheet is urged forward towards front wall 14. Corner breakers 25 prevent the forward movement of the top sheet. The top sheet therefore buckles upward until it pops out of cassette 10 for feeding to the other stations in printing apparatus 10.

In a preferred embodiment, a notch 27 in front portion 26 of receiving plate 22 aligns with a notch 15 in front wall 14. The purpose of notches 15 and 27 is to permit a photosensor (not shown) in printing apparatus 2 to detect when the paper supply on receiving plate 22 is exhausted. Thus, when paper is stacked on receiving plate 22, the photosensor aligned with notch 27 detects the white edges of the paper. As the paper is removed from receiving plate 22, front portion 26 rises upwards. When the paper is exhausted, the photosensor detects the black edge of notch 15. This information is communicated to the internal computer of printing apparatus 2 and appropriate action is taken.

Paper cassette 10 is equipped with movable paper guides 30 and 32. Paper guide 30 adjusts to the length of the paper while paper guides 32 adjust to the width of the paper. Paper guides 30 and 32 are movable and are designed to be adjusted so as to closely receive the paper within paper cassette 10. As can best be seen in FIGS. 1 and 4, paper guide 30 protrudes through bottom 18 of paper cassette 10 where it rides on tracks 34 and 36. Similarly, paper guides 32 protrude through bottom 18 where they ride on tracks (not shown) as well. Additionally, paper guides 32 are connected to a gear mechanism 38 so that they cannot be moved independently of each other but operate together. Thus, adjustment of one of the horizontal paper guides 32 necessarily adjusts the other horizontal paper guide. However, it should be noted that in this embodiment, horizontal paper guides 32 operate independently of longitudinal paper guides 30.

Figure 4:
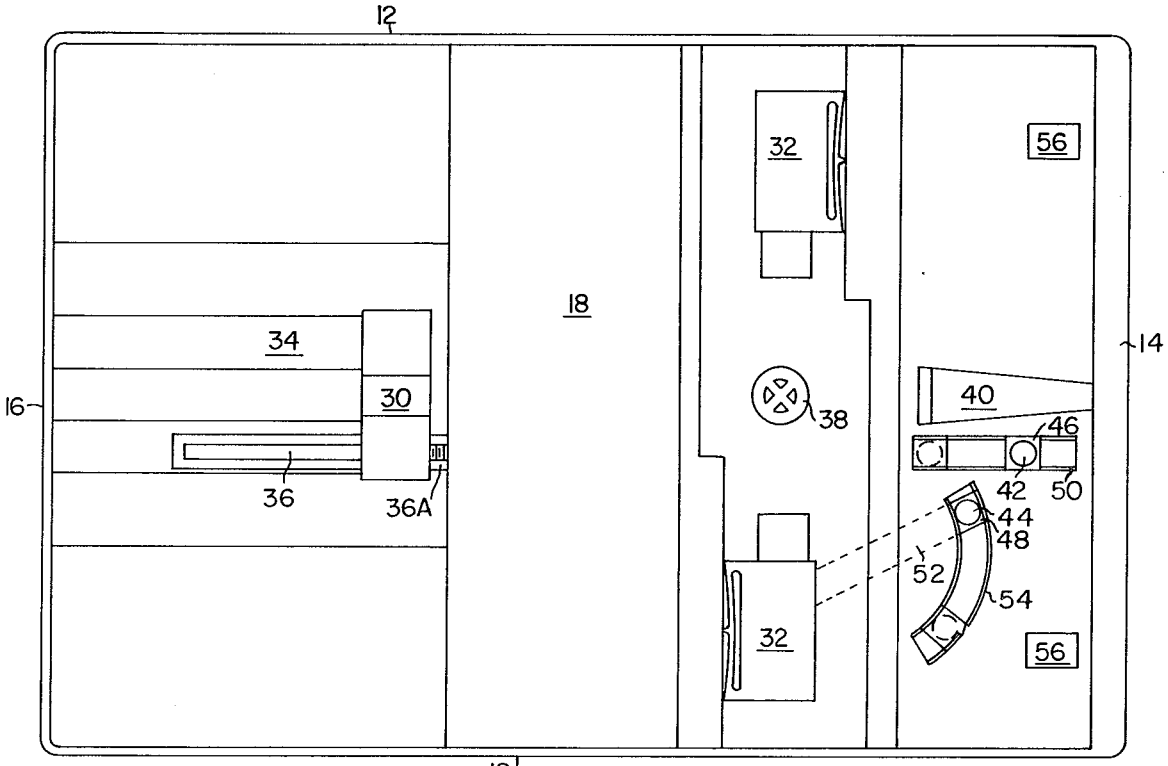
FIG. 4 is a bottom plan view of the paper feeding cassette.

As can also best be seen in FIG. 4, bottom 18 of the paper cassette tray has a trapezoidal shaped aperture 40 therein. This aperture is positioned opposite the spring loaded lever arm which urges receiving plate 22 upward. On the underside of bottom 18, are also two metallic ball bearings 42 and 44 which are set respectively inside plastic seats 46 and 48 and protrude therethrough. Seat 46 is connected by a linking arm 36A to longitudinal paper guide 30 and moves along straight track 50 in response to movements by longitudinal guide 30. Seat 48, in turn, is connected by a linkage 52 (shown in broken line) to one of the horizontal paper guides 32. Seat 48 with ball bearing 44 mounted therein travels along the arcuate path of track 54. Thus, "longitudinal" movement of paper guide 30 is translated into movement of ball bearing 42 along track 50, while "horizontal" movement of paper guides 32 is translated into arcuate movement of ball bearing 44 along track 54.

Figure 5:
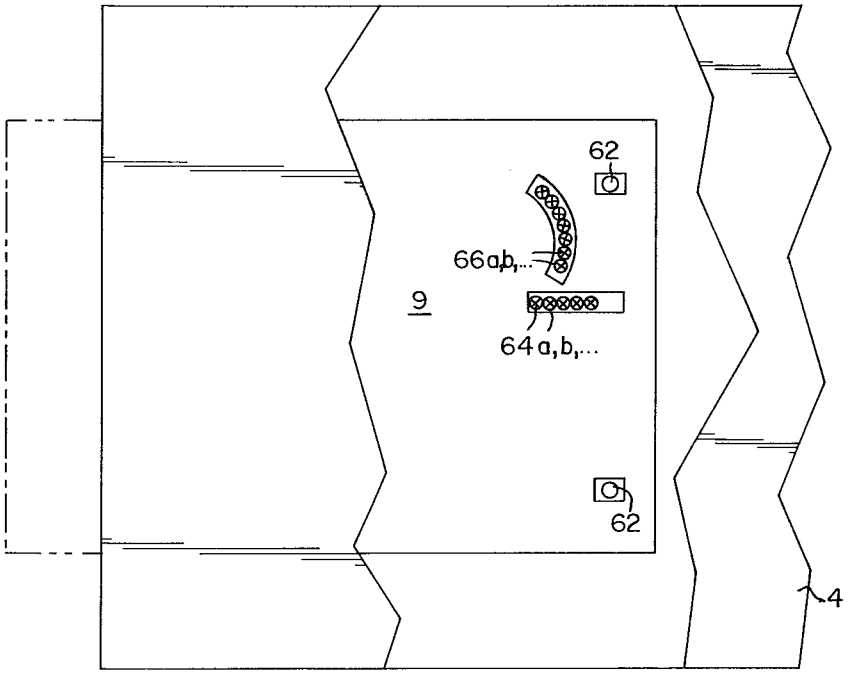
FIG. 5 is a top plan view of the plate in the printing apparatus which mates with the bottom of the paper feeding cassette.

Referring to FIG. 5, a bottom plate 9 which mates with bottom 18 of paper cassette 10 is shown. Bottom plate 9 is designed to align with the underside of bottom 18 of paper cassette tray 10. Projections 62 engage apertures 56 in bottom 18 of paper cassette tray 10. This ensures that bottom plate 9 mates securely with bottom 18.

Also illustrated in FIG. 5 are a series of sensing devices 64*a,b*, . . . and 66*a,b*, . . . which detect the presence or absence of metallic ball bearings 42 and 44. Sensing devices 64 and 66 may, for example, comprise a series of magnetic reed switches. Such switches detect the presence of a magnetic object when placed opposite thereto and thus can be made to close a circuit. As illustrated, sensing devices 64 and 66 are arranged along paths which are in register formation with tracks 50 and 54 of bottom 18. Furthermore, the individual sensing devices 64 and 66 are spaced to conform to standard lengths and widths of paper. Thus, the individual magnetic reed switches 64*a,b*, . . . and 66*a,b*, . . . are spaced so as to detect the positions of ball bearings 42 and 44 corresponding to paper of letter size, legal size, A4 size, etc.

In operation, a stack of paper is placed inside paper cassette tray 10 on top of receiving plates 22 and under corner breakers 25. Longitudinal paper guide 30 and horizontal paper guides 32 are adjusted to the length and the width of the paper. Due to the various linkages heretofore described, adjustment of paper guides 30 and 32 set ball bearings 42 and 44 in predetermined positions corresponding to the length and the width of the paper. Paper cassette tray 10 is then inserted through slots 6 into printing apparatus 2. When paper cassette tray 10 is fully inserted, projections 62 engage apertures 56 in the underside of bottom 18 of paper cassette tray 10. At the same time, the spring loaded arm thrusts upward through aperture 40 and urges the stack of paper upwards against corner breakers 25.

Simultaneously with engagement of projections 62 into apertures 56, each of ball bearings 42 and 44 is placed in registry position with one of the magnetic reed switches 64*a,b*, . . . and 66*a,b*, . . . The activated switches communicate the position of the ball bearings 42 and 44 to the internal computer of printing apparatus 2 through an electrical network. Thus, the printing apparatus detects the length and the width of the paper which has been loaded in the input paper cassette tray 10 without the need for the user to manually input this information. Appropriate formatting of the page size is then made automatically. Where printing apparatus 2 is a printer connected to a computer, the internal computer of the printer communicates this information to the host computer and appropriate formatting of the paper size is accomplished. Where the printing apparatus is a copier, the internal computer can take appropriate steps to magnify or reduce the size of the original to conform to the paper loaded in cassette tray 10.

It should be recognized that the paper cassette of the present invention can be used with printing machines which operate by methods other than electrographic printing. In addition, the cassette is adaptable for printing on forms of recording media other than paper. For example, the cassette will work when the recording medium is a plastic film such as that sold under the tradename MYLAR rather than paper.

Although the invention has been described by reference to specific embodiments, this was for purposes of illustration only and should not be construed to limit the spirit or the scope of the invention.

What is claimed is:

1. A cassette for storing and supplying a sheet of a recording medium to a printing apparatus having a controller for formatting the printing on said sheet, comprising a frame having a bottom and upwardly extending sidewalls, a movable longitudinal guide on said bottom, said longitudinal guide being adjustable to the length of said sheet, first and second movable horizontal guides on said bottom, said first and second horizontal guides being adjustable to the width of said sheet, means for linking said first and second horizontal guides together so that they move symmetrically with respect to a longitudinal central axis of said frame when they are adjusted to the width of said sheet, said longitudinal guide and said first and second horizontal guides being adjustable to the dimensions of said sheet independently of each other, said longitudinal guide and said first and second horizontal guides cooperating to closely receive said sheet within said frame, first sensing means associated with said longitudinal guide for sensing the position of said longitudinal guide, first connecting means for connecting said first sensing means to said longitudinal guide so that said first sensing means travels along a first predetermined path in conjunction with movements of said longitudinal guide, second sensing means associated with said first and second horizontal guides for sensing the position of said horizontal guides, and second connecting means for connecting said second sensing means to said first horizontal guide so that said second sensing means travels along a second predetermined path in conjunction with movements of said first horizontal guide, wherein the format of the printing on said sheet is controlled by the positions of said longitudinal and horizontal guides.

2. The cassette of claim 1 wherein said first predetermined path comprises a straight line path, and said second predetermined path comprises an arcuate path.

3. The cassette of claim 2 wherein both of said first and second predetermined paths are substantially in the same plane.

4. The cassette of claim 1 wherein said first and second sensing means comprise metal objects.

5. The cassette of claim 1 wherein said longitudinal and horizontal guides are located on one side of said bottom and said first and second sensing means are located on the other side of said bottom.

6. The cassette of claim 1 further comprising means for urging said sheet into a printing apparatus.

7. The cassette of claim 1 wherein said first and second sensing means sense a series of predetermined sheet sizes.

8. The cassette of claim 1 in combination with a printing apparatus, said printing apparatus including a plurality of detectors located adjacent said first and second predetermined paths for determining the positions of said first and second sensing means.

9. The cassette and printing apparatus combination of claim 8 wherein said detectors are magnetic reed switches.

* * * * *